US011828256B2

(12) United States Patent
Eastwood et al.

(10) Patent No.: US 11,828,256 B2
(45) Date of Patent: Nov. 28, 2023

(54) INJECTOR APPARATUS

(71) Applicant: RKLAB AG, Root (CH)

(72) Inventors: Daniel Eastwood, Shoreham-by-Sea West (GB); Riccardo Meldolesi, Shoreham-by-Sea West (GB); Martin Selway, Shoreham-by-Sea West (GB); John Lutwyche, Shoreham-by-Sea West (GB)

(73) Assignee: RKLAB AG, Root (CH)

( * ) Notice: Subject to any disclaimer, the term of this patent is extended or adjusted under 35 U.S.C. 154(b) by 0 days.

(21) Appl. No.: 17/783,286

(22) PCT Filed: Dec. 9, 2020

(86) PCT No.: PCT/EP2020/085336
§ 371 (c)(1),
(2) Date: Jun. 8, 2022

(87) PCT Pub. No.: WO2021/116200
PCT Pub. Date: Jun. 17, 2021

(65) Prior Publication Data

US 2023/0012407 A1 Jan. 12, 2023

(30) Foreign Application Priority Data

Dec. 9, 2019 (GB) ..... 1917994

(51) Int. Cl.
*F02M 57/02* (2006.01)
*F02M 49/02* (2006.01)
*F02M 47/00* (2006.01)

(52) U.S. Cl.
CPC ..... *F02M 57/026* (2013.01); *F02M 49/02* (2013.01); *F02M 47/00* (2013.01)

(58) Field of Classification Search
CPC ..... F02M 57/026; F02M 49/02; F02M 47/00
(Continued)

(56) References Cited

U.S. PATENT DOCUMENTS 2,572,118 A 10/1951 Dickson
5,685,272 A * 11/1997 Paul ..... F02M 59/366 123/446

FOREIGN PATENT DOCUMENTS

EP 0601038 A1 6/1994
GB 2236148 A 3/1991
(Continued)

OTHER PUBLICATIONS

International Search Report and Written Opinion of the International Searching Authority issued in PCT/EP2020/085336, dated Mar. 5, 2021; ISA/EP.

*Primary Examiner* — Mahmoud Gimie
(74) *Attorney, Agent, or Firm* — Harness, Dickey & Pierce, P.L.C.

(57) ABSTRACT

An injector apparatus for injecting fluid under pressure into an associated chamber, the apparatus including a body, a first piston moveable in the body, the first piston defining a first working area facing an associated chamber, a high pressure piston defining a high pressure working area facing a high pressure chamber, the first working area being greater than the high pressure working area, the first piston being operable to compress fluid in the high pressure chamber using the high pressure piston, the first piston defining a first axis, the high pressure piston defining a second axis, wherein the second axis is offset from the first axis.

14 Claims, 5 Drawing Sheets

Figure 1:
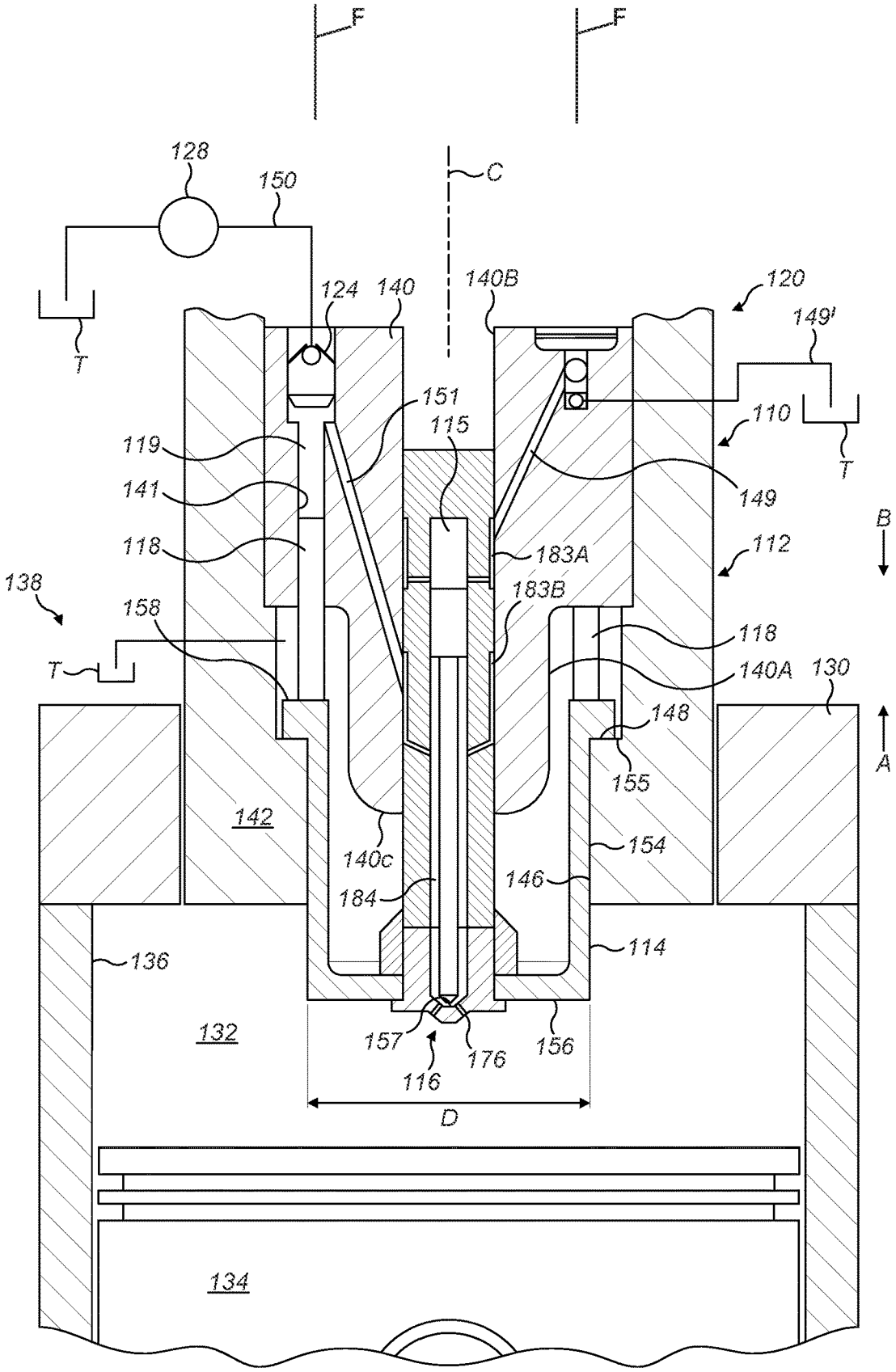

(58) Field of Classification Search
USPC ..... 123/294
See application file for complete search history.

(56) References Cited

FOREIGN PATENT DOCUMENTS

| | | | | | |
|---|---|---|---|---|---|
| GB | 2528981 | A * | 2/2016 | ..... | F02M 47/00 |
| JP | S58-82062 | A | 5/1983 | | |
| JP | S58-82063 | A | 5/1983 | | |
| WO | WO-95-12067 | A1 | 5/1995 | | |
| WO | WO-9512067 | A1 * | 5/1995 | ..... | F02M 49/02 |

* cited by examiner

INJECTOR APPARATUS

CROSS REFERENCE TO RELATED APPLICATIONS

This application is a U.S. National Phase Application under 35 U.S.C. 371 of International Application No. PCT/EP2020/085336, filed on Dec. 9, 2020, which claims priority to British Patent Application No. 1917994.4, filed on Dec. 9, 2019. The entire disclosures of the above applications are expressly incorporated by reference herein.

The present invention relates to an injector apparatus and to internal combustion engines comprising such injector apparatuses.

Although the present invention is described with reference to fuel injectors used in internal combustion engines, it is applicable to any injector apparatus for injecting a fluid under pressure into an associated chamber.

Fuel injectors used in internal combustion engines, including both spark ignition and compression ignition (or diesel) engines, generally utilise an external pump for supplying the fuel under sufficient pressure to be injected into the engine cylinder. The timing of the injection point in the engine operating cycle is determined by external controlling of the operation of an injector valve by a mechanical or electrical means. One disadvantage of providing external pumping and the control is the need for the provision of servicing of such external systems.

According to a first aspect of the present invention, there is provided an injector apparatus for injecting fluid under pressure into an associated chamber, the apparatus including a body, a first piston moveable in the body, the first piston defining a first working area facing an associated chamber, a high pressure piston defining a high pressure working area facing a high pressure chamber, the first working area being greater than the high pressure working area, the first piston being operable to compress fluid in the high pressure chamber using the high pressure piston the first piston defining a first axis, the high pressure piston defining a second axis, wherein the second axis is offset from the first axis.

The high pressure piston may be a first high pressure piston and the high pressure chamber may be a first high pressure chamber, the injector apparatus including a second high pressure piston facing a second high pressure chamber and the high pressure working area is defined by the first high pressure piston facing the first high pressure chamber and the second high pressure piston facing the second high pressure chamber.

The second high pressure piston may define a second high pressure piston axis wherein the second high pressure piston axis is offset from the first axis.

The high pressure piston may be a first high pressure piston and the high pressure chamber may be a first high pressure chamber, the injector apparatus including a plurality of further high pressure pistons facing a corresponding plurality of further high pressure chambers and the high pressure working area is defined by the first high pressure piston facing the first high pressure chamber and the plurality of further high pressure pistons facing the corresponding plurality of further high pressure chambers.

Each further high pressure piston may define a corresponding further high pressure piston axis and all of the further high pressure piston axes are offset from the first axis.

According to a further aspect of the present invention, there is provided an injector apparatus for injecting fluid under pressure into an associated chamber, the apparatus may include a body, a first piston moveable in the body, the first piston defining a first working area facing an associated chamber, a high pressure piston defining a high pressure working area facing a high pressure chamber, the first working area being greater than the high pressure working area, the first piston being operable to compress fluid in the high pressure chamber using the high pressure piston the injector apparatus having a first configuration having a first ratio of the first working area to high pressure working area and having a second configuration having a second ratio of the first working area to the high pressure working area, wherein a first ratio is different from the second ratio.

The high pressure piston may be defined by a plurality of high pressure pistons and the high pressure chamber may be defined by a corresponding plurality of high pressure chambers and the high pressure working area of first ratio may be defined by a first selection of the plurality of high pressure pistons facing the corresponding high pressure chambers and the high pressure working area of the second ratio may be defined by a second selection of the plurality of high pressure pistons facing the corresponding high pressure chambers, wherein the first selection may be different to the second selection.

The first selection may be all of the plurality of high pressure pistons facing the corresponding high pressure chambers and the second selection may not be all of the plurality of high pressure pistons facing the corresponding high pressure chambers.

The first selection may not be all of the plurality of high pressure pistons facing the corresponding high pressure chamber and the second selection may not be all of the plurality of high pressure pistons facing the corresponding high pressure chamber.

The injector apparatus may have a third configuration having a third ratio of the first working area to high pressure working area wherein the third ratio may be different to the first ratio and second ration.

The high pressure working area of the third ratio may be defined by a third selection of the plurality of high pressure pistons facing the corresponding high pressure chambers, the third selection being different to the first selection and second selection.

When in the second configuration at least one high pressure chamber may be vented to a low pressure region.

The injector apparatus may include return spring configured to bias the first piston towards the associated chamber during use.

The first piston may be freely moveable relative to the body. In such embodiments, the first piston is moved towards and away from the associated chamber during use due to pressure imbalances above and below the first piston. Alternatively, the injector apparatus may further comprise a return spring configured to bias the first piston towards the associated chamber during use. In this manner, it can be possible to supply the injector apparatus with fluid even when the pressure in the combustion chamber is higher than on the opposite side of the first piston. This can provide greater flexibility in the amount and timing of a flow of low pressure fluid into the injector apparatus for cooling during operation.

According to an aspect of the present invention there is provided a reciprocating internal combustion engine comprising at least one combustion chamber and at least one injector apparatus according to any preceding aspect, the at least one injector apparatus being configured to inject fluid under pressure into the at least one combustion chamber.

Figure 4:
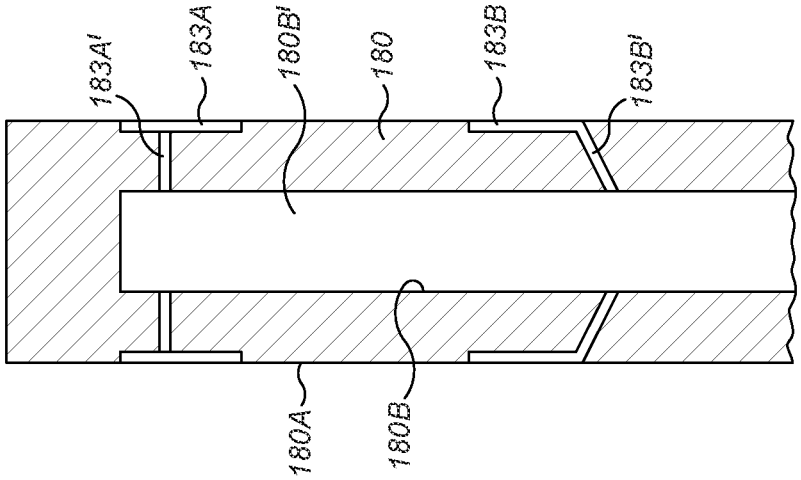
Figure 3:
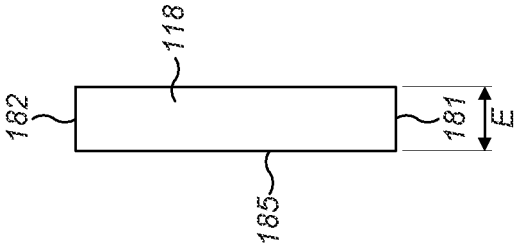
Figure 2:
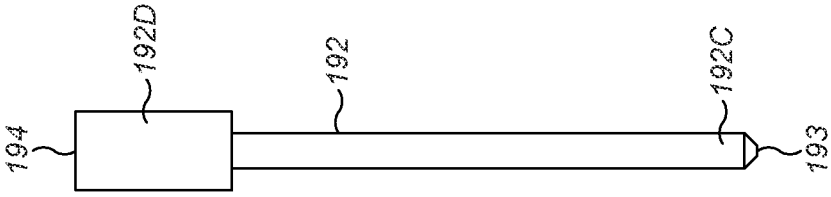

The invention will now be described, by way of example only, with reference to the accompanying drawings in which:

FIG. 1 is a cross-section of an injector apparatus according to the present invention, FIGS. 2 to 4 are enlarged views of parts of FIG. 1, and FIGS. 5A to 5C are different cross-sections of an injector apparatus 110' according to the present invention.

With reference to FIGS. 1 to 4 there is shown an injector apparatus 110 having a body 112, a first piston 114, an injector nozzle 116, and second pistons 118.

The injector apparatus further includes a control volume vent valve 120.

In use, the injector apparatus is attached to a cylinder head 130 (shown schematically) or the like with the nozzle being configured to inject fluid into an associated chamber 132, such as an internal combustion chamber. The associated chamber 132 varies in volume as a piston 34 reciprocates within a cylinder 136 of an internal combustion engine 38.

In use, a pump 128 may be connected to a low pressure region, in this case to a tank T. The tank T may supply fluid to the pump 128 and may also receive fluid from the injector apparatus as will be further described below.

The body 112 has a first part 140 and a second part 142. The second part 142 is secured to the first part 140.

The second part 142 includes a bore 146 having an internal diameter D, in one example D=25 mm. The second part 142 has a shoulder 148.

The first part 140 includes a passage 149 being associated with the control volume vent valve 120. First part 140 includes a passage 150 (shown schematically) associated with a check valve 124.

The first piston 114 has a piston wall 154 sized to be a close sliding fit within bore 146 of the second part 142 so as to essentially seal the wall 154 with the bore 46. The first piston 114 includes a shoulder 155 and an end wall 156 having injector nozzle 116. The end wall 156 defines a valve seat 157.

The injector nozzle 16 includes a plurality of injector orifices 176.

In this case there are three high pressure pistons 118 (each having an axis F), only two of which can be seen in FIG. 1. The three high pressure pistons are equi-spaced around an axis C of the injector apparatus 110 and are identical. Each high pressure piston is elongate having a diameter E (which defines a surface 185), a first end surface 181 and a second end surface 182. Each high pressure piston is slideable within a corresponding bore 141 of the first part 140. The sizing of diameter E and associated bore 141 is such as to create a close sliding fit so as to essentially seal surface 185 with bore 141. Each end surface 181 engages a surface 158 of the first piston 114. Each second end surface 182 and associated bore 141 define a high pressure chamber 119. Collectively the three second end surfaces 182 define the high pressure working area as will be described below.

First part 140 includes an outer surface 140A, an inner surface 140B and an end surface 140C.

Attached to first piston 114 is a stem 180 which depends upwardly when viewing FIG. 6. The stem 180 is cylindrical with an outer surface 180A and inner surface 180B defining a bore 180B' The outer surface 180A includes a circular groove 183A and a circular groove 183B. Passage 183A' fluidly connects groove 183A to inner surface 180B and passage 183B' fluidly connects groove 183B to inner surface 180B.

A valve element 192 is generally elongate and includes a first end 192C and a second end 192D. The diameter of the first end 192C is smaller than the diameter of the second end 192D.

First end 192C defines a valve surface 193 selectively engageable with and selectively disengageable from the valve seat 157, as will be further described below.

Second end 192D is received in a bore 180B' defined by inner surface 180B. The sizing of the second end 192D and bore 180B' is such that the valve element 192 is a sliding fit within the bore 180B', the sizing being such as to allow a small amount of fluid to pass from region 184 to the control chamber 115. Thus, the valve element 192 can slide axially relative to the bore 180B'.

As best seen in FIG. 1, the second end 192D is positioned part way along bore 180B' thereby defining a control volume 115 above second end 192D and a region 184 generally below the second end 192D.

The control chamber 115 is generally cylindrical and is defined by end surface 194 of second end 192D and part of inner surface 180B. At an end of the control chamber 115 opposite end surface 194 is passage 149 which fluidly connects control chamber 115 to the control volume vent valve 120.

Each high pressure piston faces a check valve 124 (only one of which is shown). Passages 150 are connected to the "upstream" side of check valves 124.

A solenoid 120' can be used to open the control volume vent valve 120 thereby connecting passage 149 to passage 149' which in turn is connected to tank T. Deactivation of the solenoid 120' causes the control volume vent valve 120 to close thereby isolating passage 149 from passage from 149'.

The first end 192C of the valve element 192 is sized so as to create a clearance between the first end 192C and the inner surface 180B thereby allowing fluid from each high pressure chamber 119 to pass through corresponding passages 151, circular groove 183B, passages 183B', region 184 to the injection orifices 176 and into the combustion chamber or the like as will be further described below.

As best seen in FIG. 1, a portion of outer surface 140A proximate end surface 140C is received within an upper portion of the first piston 114.

However, as can be seen, there is a clearance between lower portion of outer surface 140A and the first piston 114.

The first piston defines a region 160. Region 160 is fluidly connected to tank T (shown schematically).

Operation of the injector apparatus is as follows:—Prior to injection the control chamber 115, high pressure chambers 119, and region 160, are all primed with fluid supplied via pump 28. The fluid is at relatively low pressure (e.g. 3-5 bar). The first piston 114 is in its lowermost position (when considering FIG. 6) such that shoulder 155 of the first piston 114 is in engagement with shoulder 148 of the body. The valve element 192 is also in its lowermost position such that valve surface 193 is in engagement with valve seat 157 thereby isolating the orifices 176 from the high pressure chambers 119. Control volume vent valve 120 is closed. Check valves 124 are all closed.

As the piston 134 ascends within cylinder 136 during the compression stroke of the internal combustion engine 138, pressure is developed within the combustion chamber 132. This increasing pressure acts on the first working area of the first piston i.e. the area defined by diameter D of the first piston, i.e. an area equal to $piD^2/4$. Thus the increase in pressure within the combustion chamber 132 creates a force on the first piston 114 in the direction of arrow A. However, the first piston does not move in the direction of arrow A because the upward force on piston 114 is resisted by fluid within the three high pressure chambers 119 being hydraulically locked (by virtue of check valves 124) and hence causing a reaction force in direction B on the shoulder 158 of the first piston. The collective effective area of the three high pressure piston is therefore the total area of the second end surfaces 182 i.e. 3 $piE^2/4$. Note that since the control chamber is defined by components that are fixed relative to the first piston no reaction force is provided by fluid in the control chamber. Note that since regions 160 and 161 are connected to tank, no reaction force can be provided by fluid within these regions of the injector apparatus.

As will be appreciated, the collective effective area of the three high pressure piston is significantly smaller than the effective area of the first piston 114, and as such the pressure within the high pressure chambers will be greater than the pressure created in the combustion chamber 132 of the internal combustion engine. This allows extremely high injection pressures e.g. above 3000 bar.

In order to start injection, a control system (not shown) causes the control volume vent valve 120 to open e.g. by powering the solenoid 120'. This fluidly connects passage 149 to passage 149', and hence fluidly connects the control chamber 115 to tank T. Thus, the pressure in the control chamber falls but the pressure in the high pressure chamber remains relatively high thereby causing the valve member 92 to move in the direction of arrow A, i.e. upwardly when viewing FIG. 1 so as to disengage the valve surface 193 from the valve seat 157 thereby fluidly connecting the high pressure chamber 119 with the injector orifices 176. This allows the fluid within the high pressure chambers to be injected through the orifices 176 into the internal combustion chamber, thereby initiating combustion. As fluid is injected, the first piston progressively moves in the direction of arrow A, i.e. rises when viewing FIG. 1. Because the valve surface 193 has disengaged the valve seat 157 and because as the first piston moves upwardly the control chamber also moves upwardly then it is not necessary to continue to vent the control chamber during injection. In this manner, during injection, it is possible to ensure that the valve surface 193 of the valve element 192 remains disengaged from the valve seat 157 of the first piston.

In order to stop injection the control volume vent valve 120 is closed thereby isolating passage 149 from passage 149' and hence isolating the control chamber from tank T. The pressure in the control chamber is then equalised with the pressure in region 184 (and hence equalised with the pressure in the high pressure chamber 119) by virtue of fluid passing from region 184 past end 192D into the control chamber 115. This causes the valve member to move in the direction of arrow B relative to the first piston thereby causing the valve surface 93 to engage the valve seat and isolate the high pressure chambers 119 from the injector orifices 176 whereupon injection ceases.

Note that even though injection has stopped, the high pressure chamber remains pressurised by virtue of the pressure within the combustion chamber 132. Injection typically occurs towards the end of a compression stroke and/or at the start of a combustion (expansion) stroke. Because the high pressure chamber remains pressurised at the end of injection, further injection is possible during the particular compression/combustion stroke. Such "double" injection is referred to as "double strike" injection. As will be appreciated, the present invention allows for two or more distinct injections (i.e. multi-strike injection) to occur during a single compression/combustion stroke.

Once injection for a particular compression/combustion stroke has finally stopped, the pressure within the combustion chamber will fall significantly, typically when an exhaust valve or valves are opened, and consequently the pressure within the high pressure chamber 119 and region 184 will also fall significantly. The pressure within the combustion chamber 132 will remain at a relatively low pressure during an exhaust stroke and during an inlet stroke. At some time during the time period when the pressure in the combustion chamber is relatively low, the injector apparatus will be reprimed with fuel in time for the next injection event which will occur at the next compression/combustion stroke.

Thus, the control volume vent valve 120 is closed and the pump 128 provides pressurised fluid (e.g. at around 3-5 bar) which flows past the check valve 124, through passage 151 and into region 184. As mentioned above, the sizing of the second end 192D and bore 180B' is such as to allow some fuel to pass from region 184 to the control chamber 115, thereby allowing the pressure in the control chamber to equalise with the pressure in region 184 and hence the pressure in the high pressure chamber 119. This causes the valve member 192 to be biased downwards in the direction of arrow B which in turn causes the first piston 114 to be biased downwards via virtue of engagement between valve surface 193 and valve seat 157. As the first piston 114 descends, then so do the high pressure pistons 118 and the high pressure chambers 119 are consequently refilled with fuel from pump 128 coming via check valve 124.

Note the sizing of the second end 192D and bore 180B' is such as to create a restrictive orifice which allows the above mentioned repriming of the injector apparatus 110 but not so as to significantly affect the injection of fuel from the high pressure chambers 119 through the injector orifice 176 into the combustion chamber 132. In further embodiments the restrictive orifice could be created by an alternative arrangement.

Figure 5A:
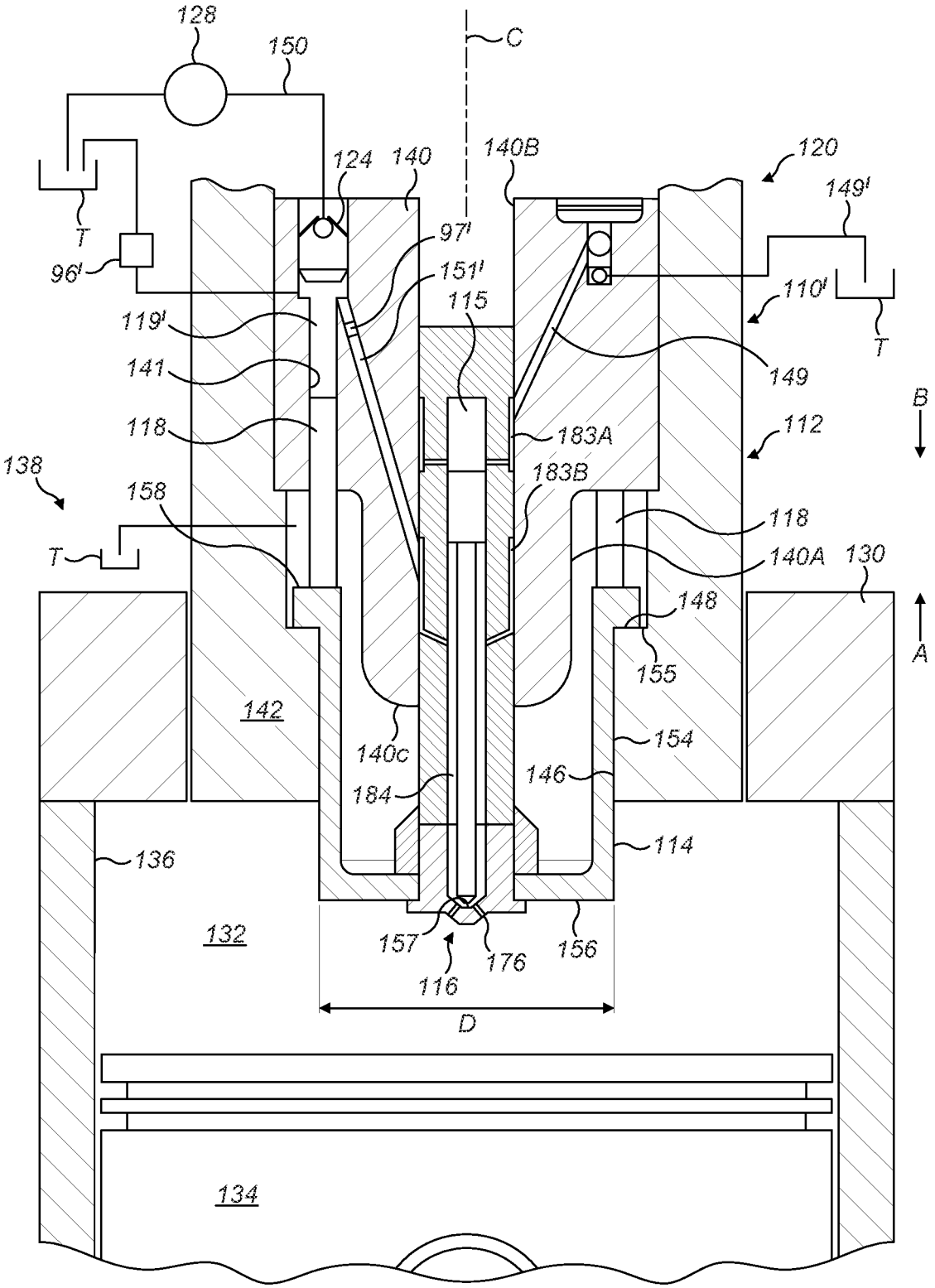
Figure 5B:
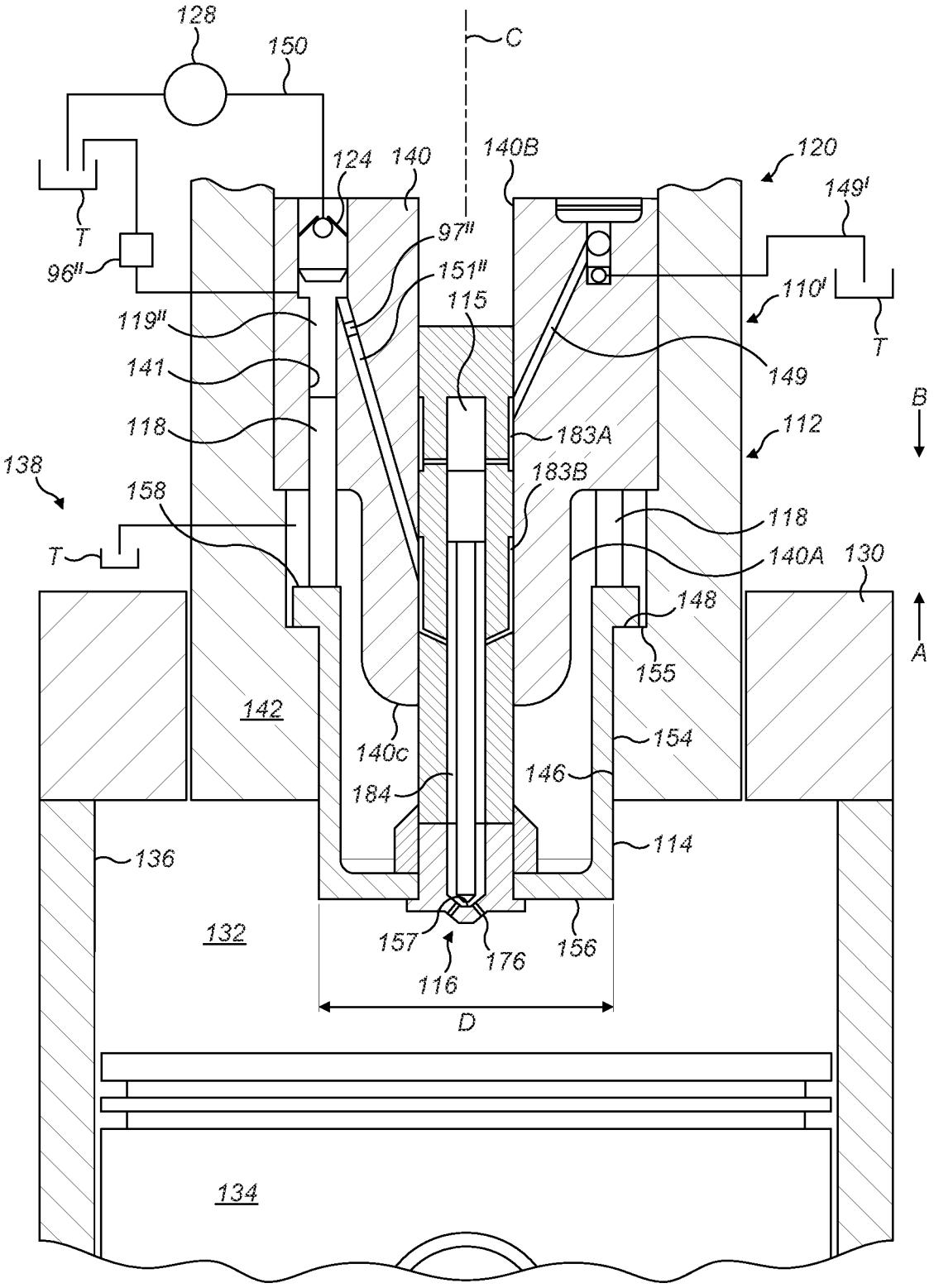
Figure 5C:
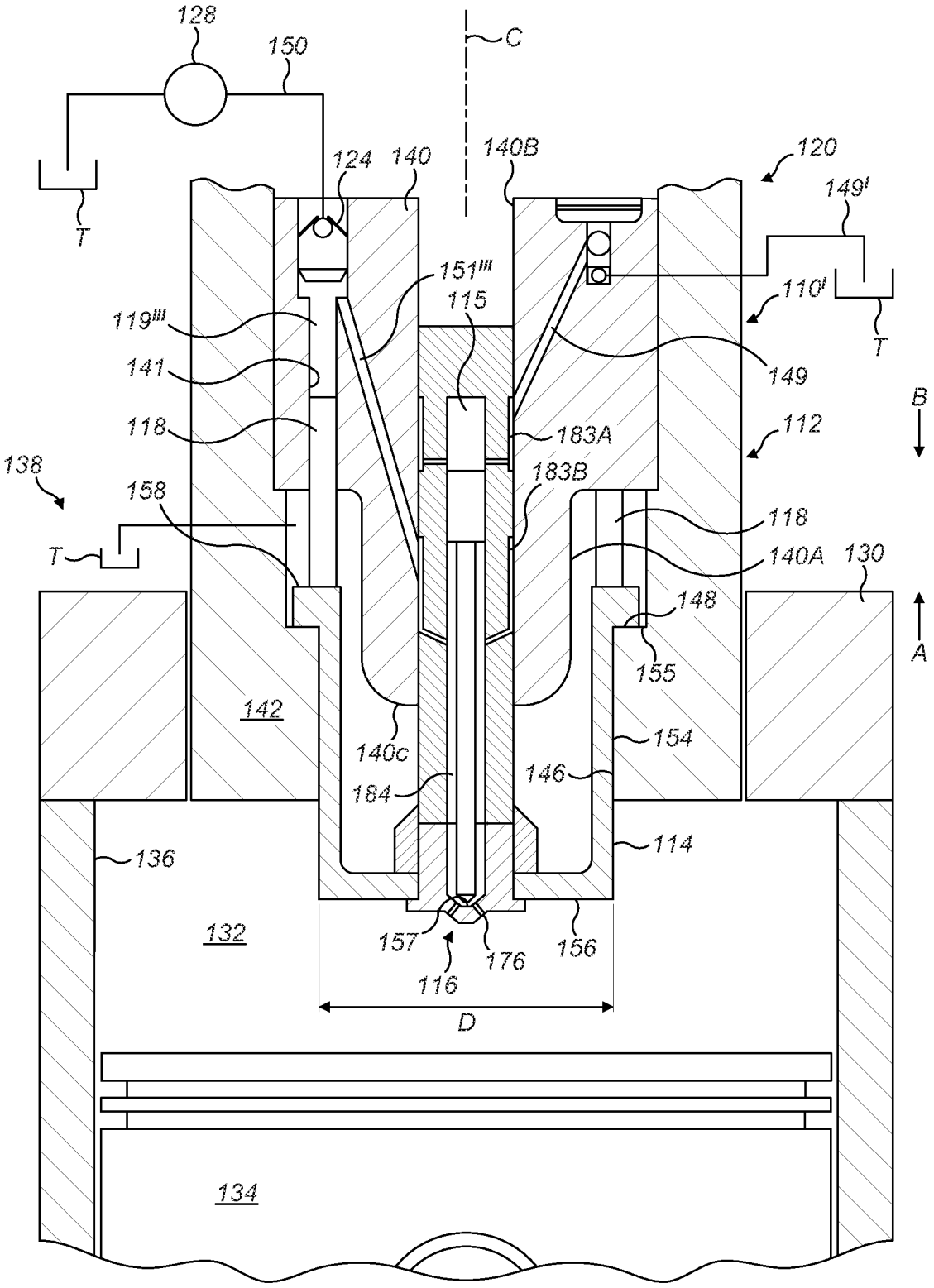

FIGS. 5A to 5C shows a variant of an injector assembly apparatus 110' which is the same as injector apparatus 110 except that associated with two of the high pressure chambers 119' and 119" are associated vent valves 96' and 96" (shown schematically) and associated check valves 97' and 97" (shown schematically).

Check valve 97' is positioned in passage 151' and check valve 97" is positioned in passage 151". Note there are no check valves in passage 151'". Check valve 97' and 97" allow fluid to flow from the high pressure chamber 119' and 119" to the region 184 but prevent reverse flow through passage 151' and 151".

Vent valves 96' and 96" can be selectively independently opened thereby connecting high pressure chambers 119' and 119" with tank T. Vent valves 96' and 96" can be selectively independently closed, thereby isolating the high pressure chamber 119' and 119" from tank.

The injector apparatus 110' allows the ratio of [the effective areas of the high pressure pistons] to [effective area of the first piston] to be varied.

In a first configuration vent valves 96' and 96" are closed. Under these circumstances the injector apparatus 110' operates as described above with respect to injector apparatus 110. In particular the collective effective area of the three high pressure pistons is the total area of the second end surfaces 182 i.e. 3 $piE^2/4$.

In a second configuration, vent valve 96' is open and vent valve 96" is closed. As such, high pressure chamber 119' cannot generate any pressure and is therefore "disabled". Under these circumstances the high pressure working area is reduced from 3 $piE^2/4$ down to 2 $piE^2/4$. As such, the pressure in the high pressure chambers 119" and 119'" is increased.

In a third configuration vent valve 96' and 96" are both opened and under these circumstances high pressure chambers 119' and 119" are unable to generate any pressure and hence are both "disabled". As such, the high pressure working area is further reduced to $piE^2/4$ and the pressure is high pressure chamber 119" is increased.

Advantageously, by selectively enabling/disabling certain high pressure chambers enables fluid to be injected at different pressures and this is advantageous at certain operating conditions of the associated internal combustion engine.

As described above, the high pressure chambers 119 of FIG. 1 all have the same diameter. Similarly, the high pressure chambers 119', 119" and 119" of FIGS. 5A to 5C all have the same diameter. In a further embodiment having a plurality of high pressure pistons, the diameter of one of the pistons may differ from the diameter of another of the pistons. In particular, an injector apparatus may have just two high pressure pistons of different diameters, facing associated high pressure chambers. Enabling or disabling the high pressure chambers provides for three high pressure working areas:

a) a first high pressure working area where both high pressure chambers are enabled, b) a second high pressure working area where one of the high pressure chambers is enabled and the other is disabled, and c) a third high pressure working area where said one of the high pressure chambers is disabled and said other of the high pressure chambers is enabled.

The invention claimed is:

1. An injector apparatus for injecting fluid under pressure into an associated chamber, the apparatus comprising:

a body, a first piston moveable in the body, the first piston defining a first working area facing an associated chamber, a first high pressure piston defining a high pressure working area facing a first high pressure chamber, a second high pressure piston facing a second high pressure chamber and the high pressure working area is defined by the first high pressure piston facing the first high pressure chamber and the second high pressure piston facing the second high pressure chamber, the first working area being greater than the high pressure working area, the first piston being operable to compress fluid in the high pressure chamber using the high pressure piston, the first piston defining a first axis, the high pressure piston defining a second axis, wherein the second axis is offset from the first axis.

2. The injector apparatus as defined in claim 1 wherein the second high pressure piston defines a second high pressure piston axis wherein the second high pressure piston axis is offset from the first axis.

3. The injector apparatus as defined in claim 1 wherein the injector apparatus comprising a plurality of further high pressure pistons facing a corresponding plurality of further high pressure chambers and the high pressure working area is defined by the first high pressure piston facing the first high pressure chamber, the second high pressure piston facing the second high pressure chamber and the plurality of further high pressure pistons facing the corresponding plurality of further high pressure chambers.

4. The injector apparatus as defined in claim 3 wherein each further high pressure piston defines a corresponding further high pressure piston axis and all of the further high pressure piston axes are offset from the first axis.

5. The injector apparatus as defined in claim 1, further comprising a return spring configured to bias the first piston towards the associated chamber during use.

6. A reciprocating internal combustion engine comprising at least one combustion chamber and at least one injector apparatus as defined in claim 1, the at least one injector apparatus being configured to inject fluid under pressure into the at least one combustion chamber.

7. An injector apparatus for injecting fluid under pressure into an associated chamber, the apparatus comprising:

a body, a first piston moveable in the body, the first piston defining a first working area facing an associated chamber, a plurality of high pressure pistons defining a high pressure working area facing a corresponding plurality of high pressure chambers, the first working area being greater than the high pressure working area, the first piston being operable to compress fluid in the high pressure chamber using the high pressure piston the injector apparatus having a first configuration having a first ratio of the first working area to high pressure working area and having a second configuration having a second ratio of the first working area to the high pressure working area, wherein the first ratio is different from the second ratio, the high pressure working area of the first ratio is defined by a first selection of the plurality of high pressure pistons facing the corresponding high pressure chambers, and the high pressure working area of the second ratio is defined by a second selection of the plurality of high pressure pistons facing the corresponding high pressure chambers, wherein the first selection is different to the second selection.

8. The injector apparatus as defined in claim 7 wherein the first selection is all of the plurality of high pressure pistons facing the corresponding high pressure chambers and the second selection is not all of the plurality of high pressure pistons facing the corresponding high pressure chambers.

9. The injector apparatus as defined in claim 7 wherein the first selection is not all of the plurality of high pressure pistons facing the corresponding high pressure chamber and the second selection is not all of the plurality of high pressure pistons facing the corresponding high pressure chamber.

10. The injector apparatus as defined in claim 7, wherein the injector apparatus has a third configuration having a third ratio of the first working area to high pressure working area wherein the third ratio is different to the first ratio and second ratio.

11. The injector apparatus as defined in claim 10 wherein the high pressure working area of the third ratio is defined by a third selection of the plurality of high pressure pistons facing the corresponding high pressure chambers, the third selection being different to the first selection and second selection.

12. The injector apparatus as defined in claim 7, wherein when in the second configuration at least one high pressure chamber is vented to a low pressure region.

13. The injector apparatus as defined in claim 7, further comprising a return spring configured to bias the first piston towards the associated chamber during use.

14. A reciprocating internal combustion engine comprising at least one combustion chamber and at least one injector apparatus as defined in claim 7, the at least one injector apparatus being configured to inject fluid under pressure into the at least one combustion chamber.

* * * * *